US009625224B2

(12) United States Patent
Olsen

(10) Patent No.: US 9,625,224 B2
(45) Date of Patent: Apr. 18, 2017

(54) BOLT RECOIL TANG CLAMPING SYSTEM

(71) Applicants: Mega Arms LLC, Centralia, WA (US); Killer Innovations Incorporated, Olympia, WA (US)

(72) Inventor: Richard B. Olsen, Yelm, WA (US)

(73) Assignees: Mega Arms LLC, Centralia, WA (US), part interest; Killer Innovations Incorporated, Olympia, WA (US), part interest ( * ) Notice: Subject to any disclaimer, the term of this patent is extended or adjusted under 35 U.S.C. 154(b) by 0 days.

(21) Appl. No.: 14/981,375

(22) Filed: Dec. 28, 2015

(65) Prior Publication Data

US 2016/0187087 A1 Jun. 30, 2016

Related U.S. Application Data

(60) Provisional application No. 62/097,323, filed on Dec. 29, 2014.

(51) Int. Cl.
*F41A 3/66* (2006.01)
*F41C 7/00* (2006.01)

(52) U.S. Cl.
CPC . *F41A 3/66* (2013.01); *F41C 7/00* (2013.01)

(58) Field of Classification Search
CPC .. F41A 3/66; F41A 11/00; F41A 11/02; F41C 7/00
USPC ..... 42/75.03
See application file for complete search history.

(56) References Cited

U.S. PATENT DOCUMENTS 1,194,504 A * 8/1916 Johnson ..... F41A 21/482 42/75.02
3,183,617 A * 5/1965 Ruger ..... F41A 21/484 42/25
3,206,885 A * 9/1965 Dye ..... F41C 23/00 42/75.03
3,208,178 A * 9/1965 Seiderman ..... F41A 21/48 42/71.01
3,830,003 A * 8/1974 Clerke ..... F41C 23/00 42/71.01
4,282,671 A * 8/1981 Wood ..... F41C 23/16 42/75.01
4,312,146 A * 1/1982 Koon, Jr. ..... F41C 23/00 42/75.03
4,385,464 A * 5/1983 Casull ..... F41C 23/00 42/75.03
5,540,008 A * 7/1996 Kirnstatter ..... F41A 21/484 42/75.02

(Continued)

*Primary Examiner* — Joshua Freeman
(74) *Attorney, Agent, or Firm* — Kathleen T. Petrich; Miller Nash Graham & Dunn LLP

(57) ABSTRACT

A self-adjusting clamping system top capture and hold a recoil lug extending outwardly from a bolt style receiver of a firearm. At least a lower portion of the receiver and the recoil lug are received into a chassis having a recess. The chassis is configured to receive an anvil block confronting the rear surface of the recoil lug. The chassis is configured to receive a tightening system confronting the front surface of the recoil lug. The anvil block has a front surface that contacts and confronts the rear surface of the recoil lug. The anvil block also has a rear surface that is outwardly rounded. The tightening system is at least partially wedge-shaped having a front surface that is angled and a rear surface that contacts and closely confronts the front surface of the recoil lug.

13 Claims, 6 Drawing Sheets

(56) References Cited

U.S. PATENT DOCUMENTS 6,487,805 B1 * 12/2002 Reynolds ..... F41A 21/485 42/75.03
7,726,060 B1 * 6/2010 Jones ..... F41A 3/66 42/75.02
7,886,473 B2 * 2/2011 Rotharmel ..... F41A 3/66 42/75.03
8,397,417 B2 * 3/2013 Jamison ..... F41A 21/485 42/75.03
8,578,643 B2 * 11/2013 Hasler ..... F41A 3/64 42/75.01
8,769,854 B1 * 7/2014 Battaglia ..... F41A 3/66 42/71.01
8,881,444 B2 * 11/2014 Warburton ..... F41A 11/00 42/74
9,285,178 B2 * 3/2016 Sellars ..... F41A 21/485
2009/0277067 A1 * 11/2009 Gregg ..... F41A 3/66 42/69.01
2010/0083551 A1 * 4/2010 Jamison ..... F41A 21/485 42/75.01
2010/0281733 A1 * 11/2010 Constant ..... F41A 3/22 42/16
2010/0319232 A1 * 12/2010 Jamison ..... F41A 21/485 42/75.03
2011/0107647 A1 * 5/2011 Johnson ..... F41A 23/16 42/97
2011/0185618 A1 * 8/2011 Jamison ..... F41A 21/00 42/75.03
2012/0180360 A1 * 7/2012 Jones ..... F41A 11/02 42/75.03
2012/0204465 A1 * 8/2012 Hasler ..... F41A 3/64 42/75.03
2015/0267988 A1 * 9/2015 Sellars ..... F41A 21/485 42/75.02
2016/0187087 A1 * 6/2016 Olsen ..... F41A 3/66 42/75.03

* cited by examiner

BOLT RECOIL TANG CLAMPING SYSTEM

RELATED APPLICATIONS

This application claims priority to U.S. provisional patent application Ser. No. 62/097,323 filed on Dec. 29, 2014, the contents of which are fully incorporated herein by reference.

TECHNICAL FIELD

The present invention relates to a self-adjusting clamping system to capture and hold a recoil lug of a bolt style receiver of a firearm relative to a chassis or rifle stock.

BACKGROUND OF THE INVENTION

Existing gun stocks do not adjust to angularity differences in the mated connection of the recoil lug of the receiver and the stock bedding unless custom epoxy or resin is applied to fill the angularity gap. This can cause the receiver to flex under recoil when the rifle is fired. This flexing motion can cause a harmonic whip in the barrel of the rifle that can throw the projectile off the intended trajectory. The flex in the receiver can also change the angularity between the back of the projectile cartridge and the bolt face. This angularity difference can also cause the bullet to project off the intended trajectory. This new system allows the stock to adjust to the angle of the recoil lug, thus eliminating the angularity difference between the two mated surfaces and increasing accuracy without custom epoxy or resin bedding work.

SUMMARY OF THE INVENTION

The invention is embodied by a self-adjusting clamping system for a firearm including a bolt style receiver and a chassis having a recess therein. The receiver includes a lower portion having an outwardly extending recoil lug having a front surface and a rear surface. The lower portion of the receiver and recoil lug are received within the recess of the chassis.

The firearm assembly of the first embodiment also includes an anvil block and a tightening system. The anvil block has a front surface and rear surface. The front surface of the anvil block is configured to contact and confront the rear surface of the recoil lug. The rear surface of the anvil block is outwardly rounded and closely conforms to a first surface of the chassis recess.

The tightening system is at least partially wedge-shaped and has a front surface that is angled and closely conforms to a second surface of the chassis recess. The tightening system also has a rear surface that is configured to contact and closely confront the front surface of the recoil lug.

In one form of the first embodiment, the outwardly rounded rear surface of the anvil block is semi-cylindrical. In another form, the outwardly rounded rear surface of the anvil block is semi-spherical.

The tightening system may be a wedge block with an angled front surface and a planar rear surface. Alternatively, the tightening system may comprise a wedge outer form having an inner wedge form and an adjacent spacer that contacts and confronts the front surface of the recoil lug.

According to another aspect of the invention, the invention may include a means for holding the recoil lug and lower portion of the receiver within a recess of a chassis where the means may include an anvil block on one side of the recoil lug and a tightening system on the other end of the recoil lug, wherein both the anvil block, recoil lug, and tightening system are closely retained relative to each other within the recess of the chassis.

These and other advantages will become more apparent upon review of the drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

Figure 5:
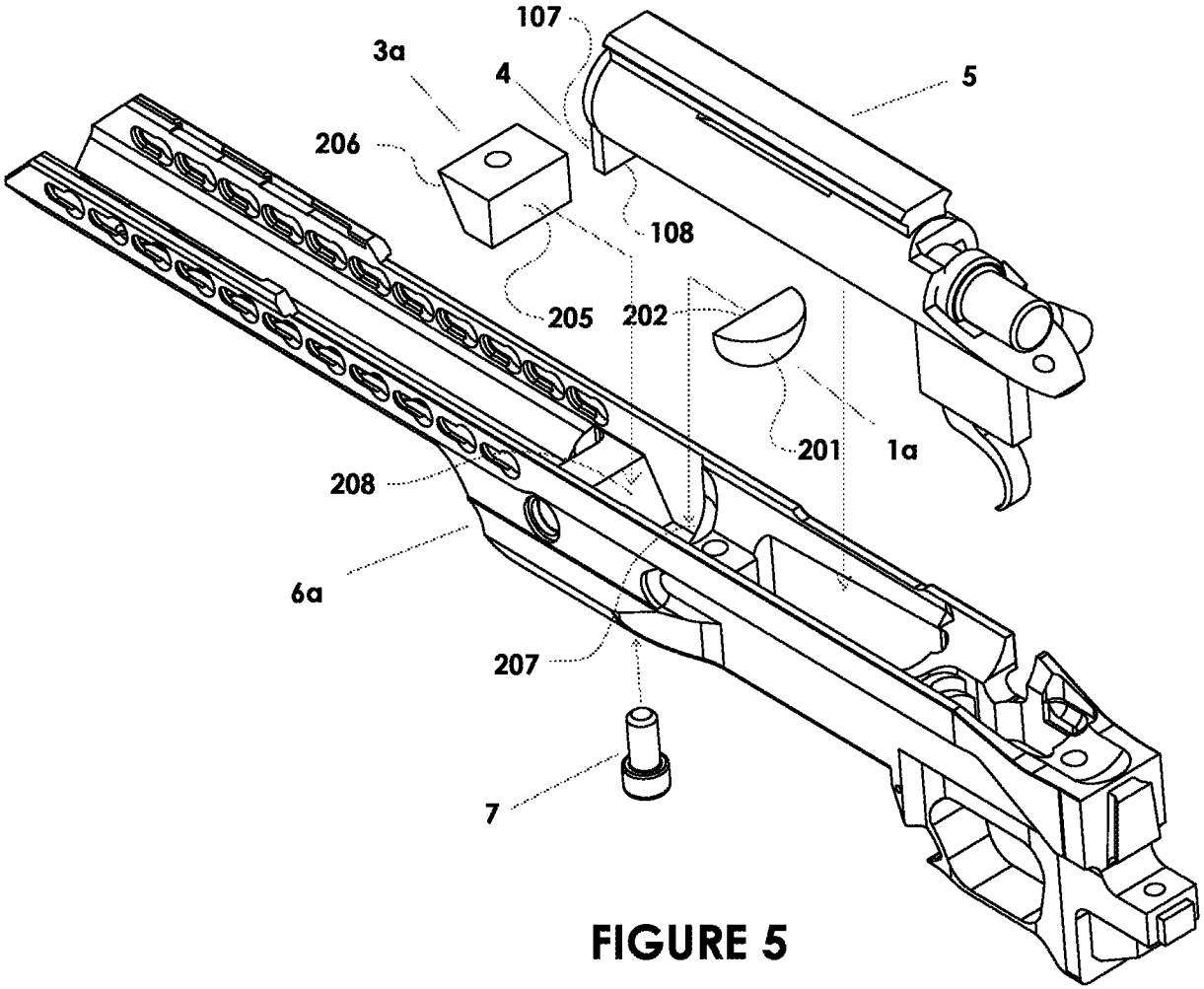
FIG. 5 is an exploded view of an alternate embodiment of the current invention, demonstrating alternate changes to the clamping system and chassis.
Figure 6:
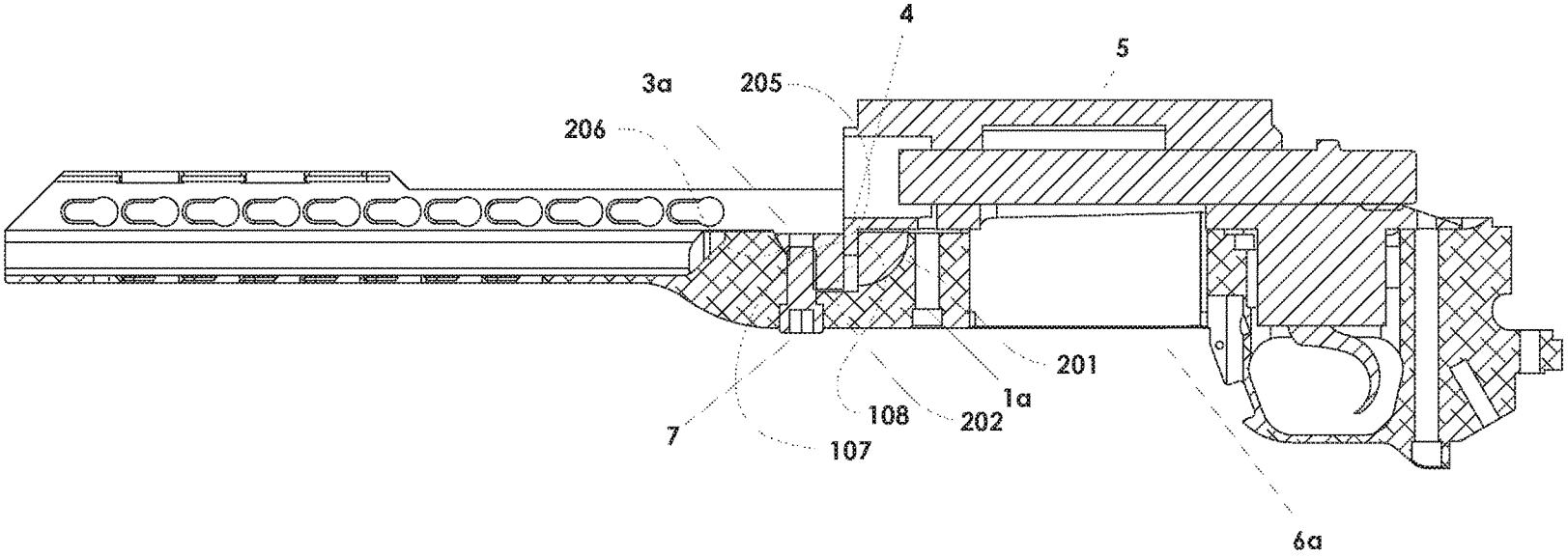
FIG. 6 is a sectional view of the embodiment from FIG. 5.

The invention is embodied by a self-adjusting clamping system to capture and hold a recoil lug of a bolt style receiver of a firearm relative to a chassis or rifle stock. A first embodiment is illustrated in FIGS. 1-4 and a second embodiment is illustrated in FIGS. 5 and 6.

Figure 1:
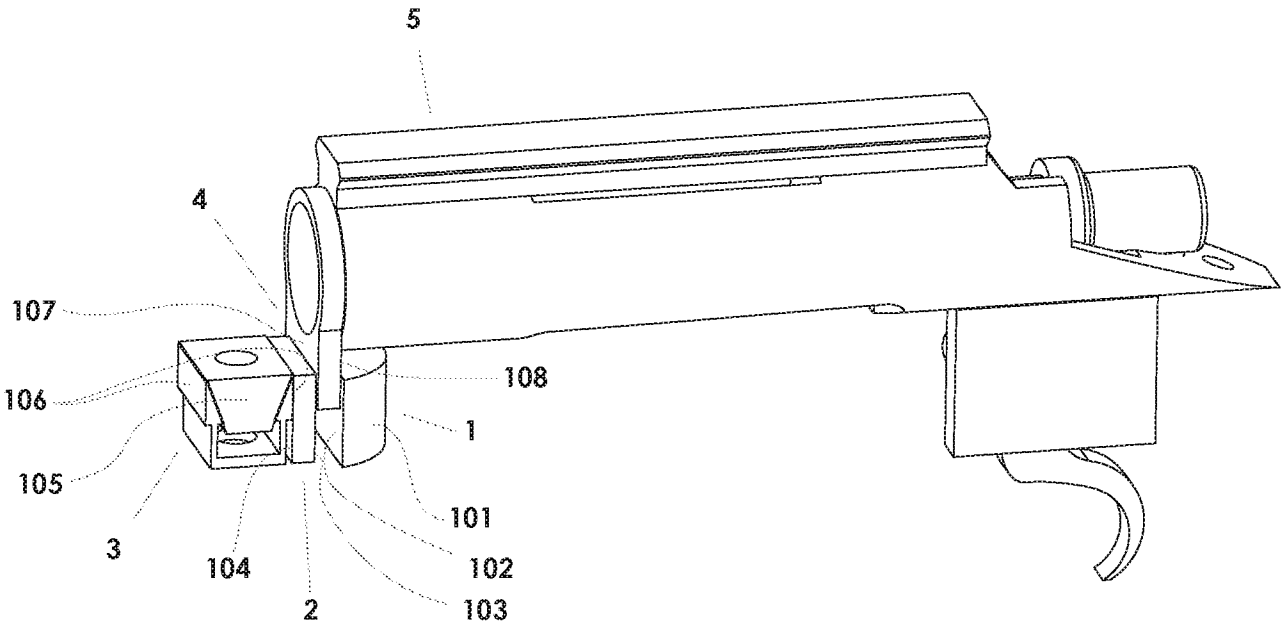
FIG. 1 is a detail of the current embodiment of the clamping system for a recoil lug of a bolt style receiver, wherein the interrelationship of the bolt style receivers recoil lug, and the clamping system is demonstrated.

Referring to FIG. 1, according to one embodiment of the invention, the clamping system for a recoil lug of a bolt style receiver 5 consists of a semi-cylindrical anvil block 1, with cylindrical side 101 and flat side 102, a spacer block 2 with flat parallel sides 103 and 104, a tightening system 3 with wedge shaped inner block 105 and outer wedged form 106, designed to capture and hold in place the recoil lug 4 of a bolt style receiver 5, along recoil lug surfaces 107 and 108. The wedge angles of the inner block 105 may range from 30 to 60 degrees. The outer wedged form 106 may include an inner angled surface that is generally complementary to the wedge angles of the inner block 105. The outer wedged form 106 may also include an outer lip as illustrated in FIGS. 1 through 4.

Figure 2:
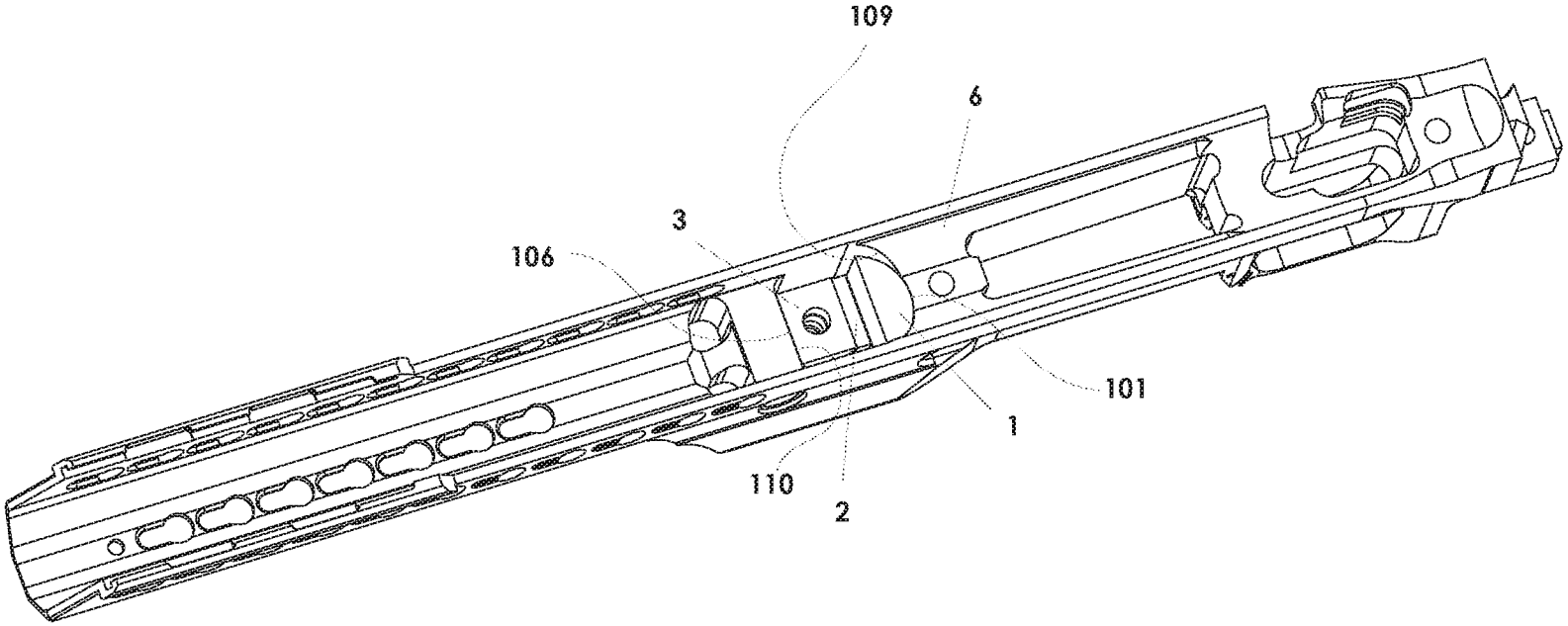
FIG. 2 depicts the current embodiment of the clamping system for a recoil lug of a bolt style receiver, as installed in its chassis.

Referring to FIG. 2, it can be seen how semi-cylindrical anvil block 1, spacer block 2 and tightening system 3 fit into chassis 6 such that cylindrical side 101 of semi-cylindrical anvil block 1 contacts cylindrical depression 109 of chassis 6, and one side 106 of tightening system 3 seats against edge 110 of chassis 6.

Figure 3:
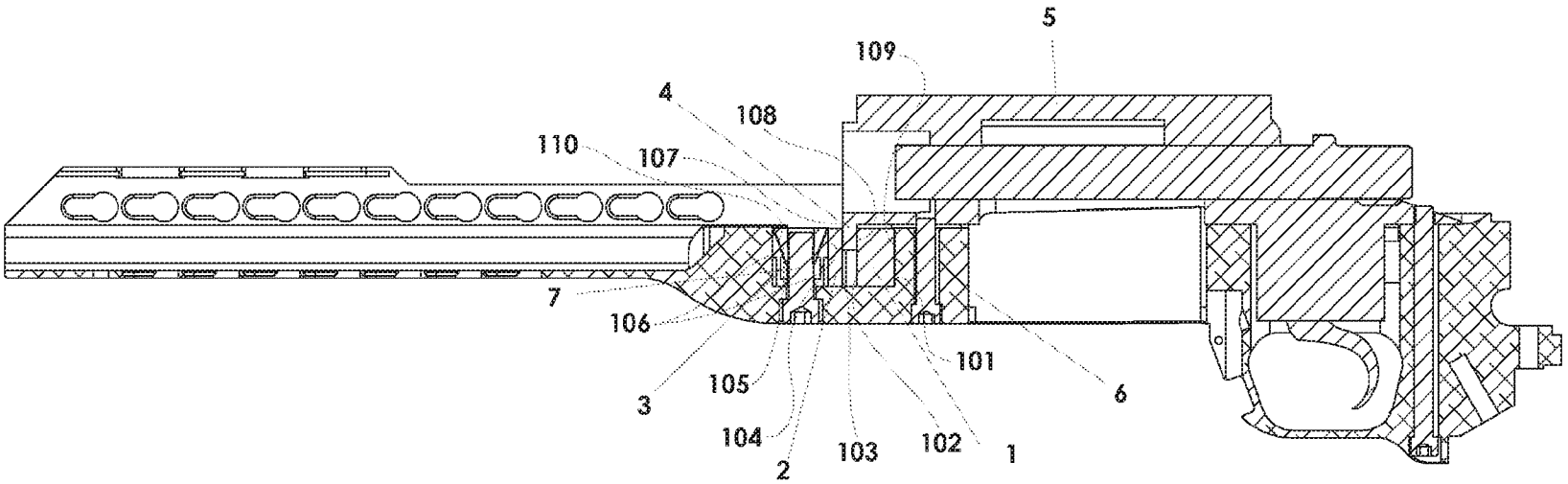
FIG. 3 is a sectional view of the current embodiment of the assembly, detailing the fit of the bolt style receiver, with its associated recoil lug, into the chassis, and how the chassis and clamping system are related to accomplish the intended clamping of the recoil lug in a positive and exact location.
Figure 4:
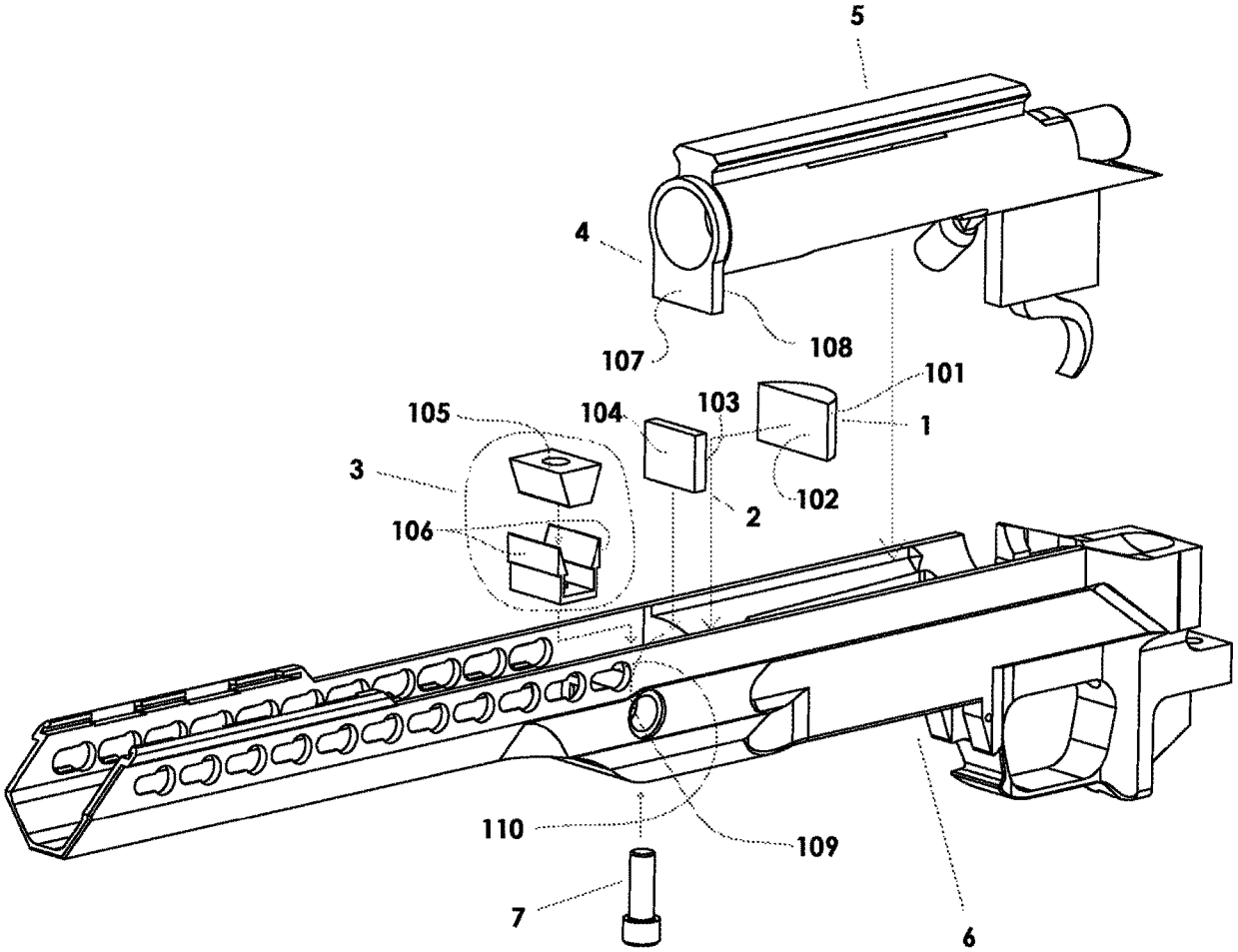
FIG. 4 is an exploded view of the current embodiment of the clamping system shown in FIG. 3, and is intended to provide an addition perspective of the assembly.

Referring to FIGS. 3 and 4, it can be seen how bolt receiver 5 can be inserted into chassis 6 in the normal fashion, causing recoil lug 4 to insert between semi-cylindrical anvil block 1 and spacer block 2, bringing surface 108 of recoil lug 4 into contact with flat side 102 of semi-cylindrical anvil block 1 and forward edge 107 of recoil lug 4 into near contact with edge 103 of spacer block 2. At this time semi-cylindrical anvil block 1 is capable of a small amount of rotation between its cylindrical side 101 and cylindrical depression 109 of chassis 6. By this small rotational motion, the flat side 102 of semi-cylindrical anvil block 1 can orient as necessary to come into complete contact with flat side 108 of recoil lug 4, thus compensating for any out-of-square condition of recoil lug 4 during its manufacture. This results in the most accurate clamping action possible for recoil lug 4. Final tightening of the system can be accomplished at this time. By tightening fastener 7, wedge shaped inner block 105 of tightening system 3 is drawn downward. This in turn causes both sides 106 of tightening system 3 to move apart, which in turn causes a compressive action through the components captured between surface 110 and cylindrical depression 109 of chassis 6. The result is that recoil lug 4 of bolt receiver 5 is held stationary, such that during the discharge of the firearm and subsequent recoil, no movement of the bolt style receiver 5 can occur, independent of the chassis 6.

Another embodiment appears in FIGS. 5 and 6 wherein the anvil block is configured as a partial sphere. This semi-sphere anvil block 1*a* serves the same purpose as the semi-cylindrical anvil block 1 of FIGS. 1 through 4, engaging the recoil lug 4 of the bolt style receiver 5 along sides 108 and 202, clamping the recoil lug 4 of bolt style receiver 5, in place during operation. In this embodiment the spherical surface 201 locates in the spherical depression 207 in chassis 6*a*, and can roll in its spherical engagement to come into full contact with the back side 108 of recoil lug 4 of bolt style receiver 5. Wedge block 3*a* has replaced tightening system 3 in this embodiment to engage the front edge 107 of recoil lug 4 against its surface 205. Wedge block 3*a* engages chassis 6*a* along angled wedge surface 206 at chassis angled surface 208, and when drawn downward in chassis 6*a* by tightening fastener 7, causes a compressive action through the components captured between surface 208 and spherical depression 207 of chassis 6*a*. Angled surface 206 may be in the range of 30 to 60 degrees. The result is that recoil lug 4 of bolt receiver 5 is held stationary, such that during the discharge of the firearm, and subsequent recoil, no movement of the bolt style receiver 5 can occur, independent of the chassis 6*a*.

The illustrated embodiments are only examples of the present invention and, therefore, are non-limitive. It is to be understood that many changes in the particular structure, materials, and features of the invention may be made without departing from the spirit and scope of the invention. For example, the self-adjusting recoil lug clamping system could be made as an insert that would be installed or molded around any rifle stock or other chassis system. Further, the half round anvil could be made to be an integral part of a receiver's recoil lug (and not a separate part). The chassis with its recess can be part of a rifle stock. Therefore, it is the Applicant's invention that its patent rights not be limited by the particularly embodiments illustrated and described herein, but rather by the following claims interpreted according to accepted doctrines of claim interpretation, including the Doctrine of Equivalents, Doctrine of Claim Differentiation, and Reversal of Parts.

The invention claimed is:

1. A firearm assembly comprising:

a bolt style receiver having a lower portion;

a recoil lug that protrudes outwardly and downwardly from the lower portion of the receiver; the recoil lug having a front surface and a rear surface;

an anvil block having a front surface and a rear surface, wherein the front surface of the anvil block is configured to confront the rear surface of the recoil lug and wherein the rear surface of the anvil block is outwardly rounded;

a tightening system having a front surface and a rear surface, wherein the front surface of the tightening system is angled and the rear surface of the tightening system is configured to confront the front surface of the recoil lug;

a chassis having a recess configured to receive at least the lower portion of the bolt style receiver and recoil lug, anvil block, and tightening system, wherein the recess includes a rounded depression that conforms to the rear surface of the anvil block and an angled surface spaced apart from the rounded depression to form a central region within the recess that is configured to closely contain the recoil lug, anvil block, and tightening system; and a fastener for holding the tightening system relative to the chassis.

2. The firearm assembly of claim 1 wherein the tightening system further comprises a wedge block having a front angled surface and a rear surface, and a spacer block having a front surface and a rear surface wherein the front surface of the spacer block is configured to confront the rear surface of the wedge block and the rear surface of the spacer block is configured to confront the front surface of the recoil lug.

3. The firearm assembly of claim 2 wherein the wedge block further comprises a wedge shaped inner block and a wedge shaped outer form, wherein the wedge shaped outer form includes the front angled surface and the rear surface configured to confront the front surface of the spacer block and the wedged shaped inner block is configured to be received within the wedge shaped outer form.

4. The firearm assembly of claim 3 wherein the wedge shaped outer form includes a front sidewall and a rear sidewall with each front and rear sidewall including an upper portion that is wedge shaped and configured to receive the wedge shaped inner block.

5. The firearm assembly of claim 1 wherein the rounded rear surface of the anvil block is semi-cylindrical in shape.

6. The firearm assembly of claim 1 wherein the rounded rear surface of the anvil block is semi-spherical in shape.

7. The firearm assembly of claim 2 wherein the front and rear surfaces of the recoil lug are planar, the rear surface of the anvil block is planar, and the front and rear surfaces of the spacer block are planar.

8. A firearm assembly comprising:

a bolt style receiver having a lower portion with a recoil lug that protrudes outwardly and downwardly from the lower portion; the recoil lug having a front surface and a rear surface;

a chassis having a recess; and self-adjusting means for capturing and holding the recoil lug within the recess of the chassis;

wherein the self-adjusting means for capturing includes an anvil block and a tightening system; the anvil block includes a front surface that is configured to contact and confront the rear surface of the recoil lug, and a rear surface that is outwardly rounded and configured to be received within a surface of the chassis; the tightening system includes a wedge shaped front surface that is configured to be received within a second surface of the chassis and a rear surface configured to contact and confront the front surface of the recoil lug.

9. The firearm assembly according to claim 8 wherein the anvil block rear surface is a semi-cylindrical surface.

10. The firearm assembly according to claim 8 wherein the anvil block rear surface is a semi-spherical surface.

11. The firearm assembly according to claim 8 wherein the tightening system comprises a wedge block and wherein the front surface is angled and the rear surface is planar.

12. The firearm assembly according to claim 8 wherein the tightening system comprises a wedge-shaped outer form with a wedge shaped inner form and a spacer bar where the spacer bar contacts and confronts the front surface of the recoil lug.

13. The firearm assembly according to claim 12 wherein the wedge shaped outer form includes one or more wedge shaped upper sidewalls.

* * * * *